US005742214A

United States Patent [19]

Toda et al.

[11] Patent Number: 5,742,214

[45] Date of Patent: Apr. 21, 1998

[54] DIELECTRIC FILTER HAVING OBLIQUELY ORIENTED STEPPED RESONATORS

[75] Inventors: Jun Toda, Ishikawa-ken; Haruo Matsumoto, Kanazawa, both of Japan

[73] Assignee: Murata Manufacturing Co., Ltd., Kyoto-fu, Japan

[21] Appl. No.: 612,027

[22] Filed: Mar. 6, 1996

[30] Foreign Application Priority Data

Mar. 8, 1995 [JP] Japan ..... 7-048664

[51] Int. Cl.[6] ..... H01P 1/20

[52] U.S. Cl. ..... 333/202; 333/206

[58] Field of Search ..... 333/222, 206, 333/202, 202 DB

[56] References Cited

U.S. PATENT DOCUMENTS

| | | | |
|---|---|---|---|
| 5,124,676 | 6/1992 | Ueno | 333/206 |
| 5,208,566 | 5/1993 | Kenoun et al. | 333/206 |
| 5,517,163 | 5/1996 | Sagawa et al. | 333/222 |

FOREIGN PATENT DOCUMENTS

| | | | |
|---|---|---|---|
| 0641035 | 3/1995 | European Pat. Off. . | |
| 2653856 | 2/1978 | Germany . | |
| 5368534 | 6/1978 | Japan . | |
| 61-258502 | 11/1986 | Japan . | |
| 290302 | 11/1990 | Japan | 333/222 |
| 108801 | 5/1991 | Japan | 333/206 |
| 4200102 | 7/1992 | Japan | 333/222 |
| 5167317 | 7/1993 | Japan | 333/222 |
| 5-226909 | 9/1993 | Japan . | |
| 2165098 | 4/1986 | United Kingdom . | |
| 2222490 | 3/1990 | United Kingdom . | |

*Primary Examiner*—Benny Lee

*Attorney, Agent, or Firm*—Ostrolenk, Faber, Gerb & Soffen, LLP

[57] ABSTRACT

In a dielectric filter having plural resonator cavities and at least one resonator cavity comprising a large inner-diameter portion, a small inner-diameter portion and a step portion formed between the large and small portions, an inner conductor being formed on the inner surface of each of the resonator cavities and an outer conductor being formed on the outer surface of the dielectric block. The large portion and the small portion of the at least one resonator cavity having the step portion are designed to have different sectional shapes, and may be either coaxial or non-coaxial.

4 Claims, 4 Drawing Sheets

DIELECTRIC FILTER HAVING OBLIQUELY ORIENTED STEPPED RESONATORS

CROSS-REFERENCE TO RELATED APPLICATION

This application is related to commonly-assigned U.S. Ser. No. 08/377,394 filed Jan. 24, 1995, now U.S. Pat. No. 5,612,654, granted 18 Mar. 1997 the disclosures of which are incorporated By reference herein.

BACKGROUND OF THE INVENTION

1. Field of the Invention

The present invention relates to a dielectric filter, and particularly to a dielectric filter in which a plurality of resonator cavities which contain resonator holes having step portions are formed in a single dielectric block.

2. Description of Related Art

Conventionally, there has been known a dielectric filter in which a step portion is formed in a resonator cavity, forming two resonant portions having different line impedance, with the step portion at the boundary thereof, thereby obtaining a desired filter characteristic. FIGS. 1A and 1B show the construction of a conventional dielectric filter in which resonator cavities having step portions as described above are formed. FIG. 1A is a perspective view of the dielectric filter, taken from the open-circuited end surface of the dielectric filter, and FIG. 1B is a plan view showing the dielectric filter, also taken from the open-circuited end surface.

The dielectric filter shown in FIGS. 1A and 1B comprises a dielectric block 1 having a substantially rectangular parallelepiped shape, and resonator cavities 2*a* and 2*b* which are formed in the dielectric block 1, so as to penetrate through a pair of confronting surfaces of the dielectric block 1. As seen in FIG. 1A, each resonator cavity has an inner conductor 3 formed on the inner surface thereof. Further, input/output electrodes 5 are formed on the outer surface of the dielectric block 1, and an outer conductor 4 is formed substantially over the whole surface of the dielectric block 1 except for the areas at which the input/output electrodes 5 are formed.

At one end surface 1*a* of the dielectric block 1 (hereinafter referred to as the "open-circuited end surface"), a portion at which no inner conductor 3 is formed (hereinafter referred to as the "non-conductor portion"), is provided at one end portion of each of the resonator cavities 2*a*, 2*b* which is in the neighborhood of the end surface 1*a* as shown in FIG. 1A. Thus the inner conductor 3 formed in each resonator cavity 2*a*, 2*b* is separated from the outer conductor 4 by this non-conductor portion. On the other hand, at the opposite end surface 1*b* (see FIG. 1A) of the dielectric block 1 (hereinafter referred to as the "short-circuited end surface), each inner conductor 3 is short-circuited to the outer conductor 4.

In the dielectric filter thus constructed, a step portion 21 is provided substantially at the center portion between the open-circuited end surface 1*a* and the short-circuited end surface 1*b* in each resonator 2*a*, 2*b*, and these resonators 2*a* and 2*b* are designed so that the inner diameter thereof at the end surface 1*a* is larger than that at the end surface 1*b*. Hereinafter, the portion of each resonator cavity 2*a*, 2*b* which has the larger inner diameter is referred to as the "large inner-diameter portion", and the other portion of the resonator cavity which has the smaller inner diameter is referred to as the "small inner-diameter portion".

In this structure, the large inner-diameter portion is formed at the side of the open-circuited end surface 1*a*, and the coupling between both resonators is ordinarily strong capacitive coupling, so that a filter characteristic having a broad pass band and an attenuation pole at a low side of the pass band is obtained. Further, the resonant frequency of each resonator which is formed in each resonator cavity 2*a*, 2*b*, and the coupling degree of the resonators, can be varied by changing the ratio of the length of the large inner-diameter portion and the length of the small inner-diameter portion of the resonator cavity 2*a* or 2*b* and the ratio of the inner diameters of the resonator cavities 2*a* and 2*b*, thereby obtaining a desired filter characteristic.

However, in the conventional dielectric filter as described above, the large inner-diameter portions and the small inner-diameter portion of the resonator cavities 2*a*, 2*b* are designed to have a circular cross-sectional shape, and the center axes thereof are disposed coaxially. This places restrictions on the self-capacitance which is formed between the inner conductor 3 and the outer conductor 4, and the mutual capacitance which is formed between the neighboring inner conductors 3, and thus the degree of freedom in the design of a desired filter characteristic is low. That is, it is difficult to obtain various filter characteristics in a dielectric block 1 having a required body size. In other words, it is difficult to design the dielectric block 1 so that it has a desired body size and also to obtain required filter characteristics.

SUMMARY OF THE INVENTION

Therefore, an object of the present invention is to provide a dielectric filter which can overcome the problem of the conventional dielectric filter as described above, and which can enhance the degree of freedom in design of the resonance frequency and the coupling degree between resonators to thereby easily obtain a desired filter characteristic.

According to a first aspect of the present invention, in order to attain the above object, a dielectric filter having plural resonator cavities contains at least one resonator cavity comprising a large inner-diameter portion, a small inner-diameter portion and a step portion formed between the large and small portions. An inner conductor is formed on the inner surface of each of the resonator cavities and an outer conductor is formed on the outer surface of the dielectric block. The large inner-diameter portion and the small inner-diameter portion of the resonator cavity having the step portion are designed to have different cross-sectional shapes.

According to a second aspect of the present invention, in the dielectric filter of the first aspect of the present invention, the center axis of the small portion of the resonator cavity having the step portion is eccentrically deviated from the center axis of the large portion.

According to the dielectric filter of the first aspect of the present invention, the large and small portions are designed to have different cross-sectional shapes, whereby the self-capacitance and the mutual capacitance at the large portion and/or the small portion can be set to various values. That is, the degree of freedom in design of the resonance frequency and the coupling degree is enhanced, and various filter characteristics can be obtained by using a dielectric filter having a desired body size.

According to the dielectric filter of the second aspect of the present invention, the axis of the small portion is eccentrically deviated from the axis of the large portion to broaden an adjustable range of the self-capacitance and the mutual capacitance.

Other features and advantages of the present invention will become apparent from the following description of the invention which refers to the accompanying drawings.

DETAILED DESCRIPTION OF EMBODIMENTS OF THE INVENTION

Figure 1A:
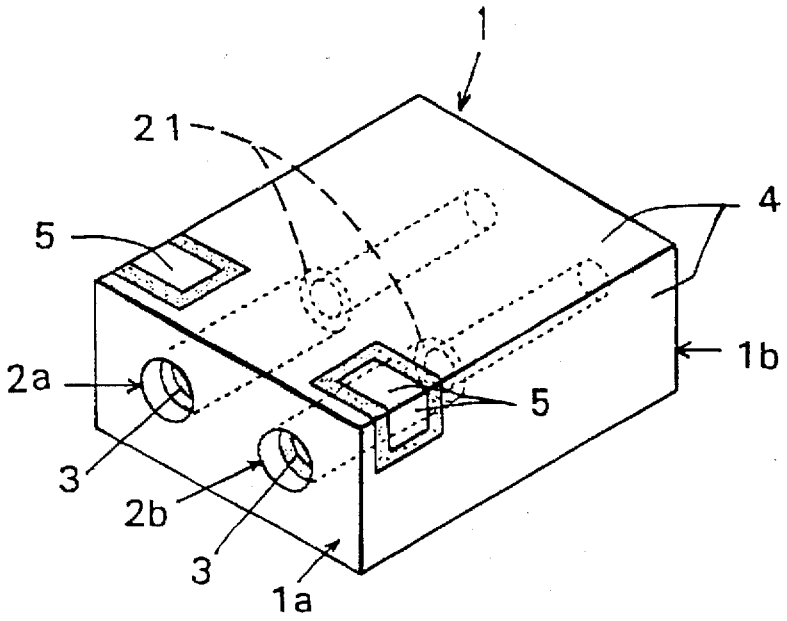
FIG. 1A PRIOR ART
FIG. 1A is a perspective view of a conventional dielectric filter.

Preferred embodiments according to the present invention will be described hereunder with reference to the accompanying drawings, in which like reference numerals denote like elements and parts, which may not be described in detail in some of the drawing descriptions. In these embodiments, the large inner-diameter portion and the small inner-diameter portion of the resonator having the step portion are designed to have different sectional shapes. The structures other than the sectional shapes of the resonator cavities in the following embodiments are substantially identical to those of the conventional resonator cavities shown in FIG. 1A, and the description thereof is omitted.

Figure 2:
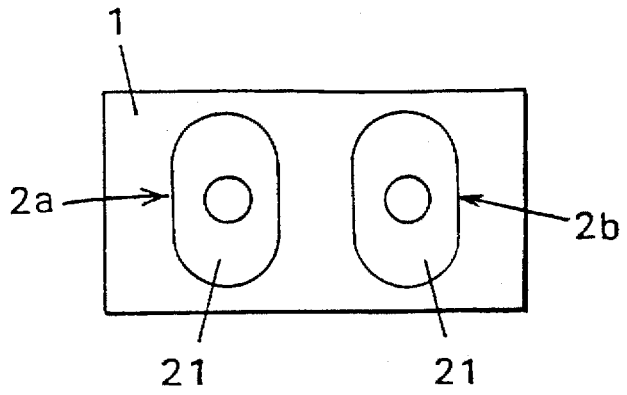
FIG. 2 is a plan view showing a dielectric filter according a first embodiment of the present invention.

FIG. 2 is a plan view of a dielectric filter according to a first embodiment of the present invention, which is taken from the side of the open-circuited end surface thereof. As shown in FIG. 2, the large inner-diameter portion of each resonator cavity 2*a* or 2*b*, having the step portion 21, is designed to have an elongated cross-section having two parallel sides and two arcuate sides, that is, it is designed approximately in an elliptical sectional shape. On the other hand, the small portion of each resonator cavity 2*a*, 2*b* is designed with a circular sectional shape. Further, the large portion is designed so that its longer diameter is parallel to the thickness (height) direction of the dielectric block 1, and the center axes of the large portion and the small portion are collinear with each other.

Figure 1B:
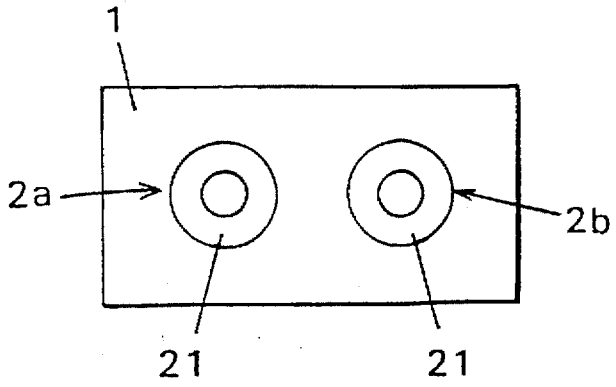
FIG. 1B PRIOR ART
FIG. 1B is a plan view of the dielectric filter of FIG. 1A which is taken from the side of an open-circuited end surface.

In this structure, since the large portion is designed approximately in an elliptical sectional shape, the distance between the outer conductor and the large portion of each resonator cavity 2*a* or 2*b* is shorter than in the conventional structure. Therefore, as compared with the conventional dielectric filter shown in FIGS. 1A and 1B, the self-capacitance at the open-circuited end can be made larger, and the mutual capacitance can be made larger because the confronting surfaces of the large portions of the neighboring resonator cavities 2*a* and 2*b* are large in area.

That is, the self-capacitance at the side of the open-circuited end surface can be increased. Thus, the line impedance at the resonance portion of the open-circuited end surface can be reduced, so that the resonance frequency can be lowered. Conversely, in order to obtain a desired resonance frequency, the length (axial length) of the dielectric block can be shortened, and thus miniaturization of the dielectric filter can be promoted.

Further, by increasing the mutual capacitance at the open-circuited end, the degree of capacitive coupling between the resonators can be further enhanced. Therefore, it is unnecessary to extremely shorten the distance between the large portions in order to obtain a desired coupling degree, so that a filter characteristic which is stable and small in characteristic fluctuation can be obtained without reducing Q-value.

Figure 3:
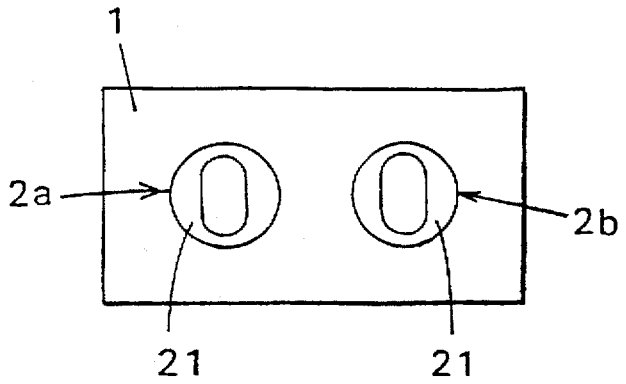
FIG. 3 as a plan view showing a dielectric filter according to a second embodiment of the present invention.

FIG. 3 is a plan view showing a dielectric filter according to a second embodiment of the present invention, which is taken from the side of the open-circuited end surface. In the dielectric filter of this embodiment, the small inner-diameter portion of each resonator cavity 2*a*, 2*b*, having the step portion 21, is designed approximately in an elliptical sectional shape, and the large inner-diameter portion of each resonator cavity 2*a*, 2*b a* is designed in a circular sectional shape. The longer diameter of the inner-diameter small portion is parallel to the thickness (height) direction of the dielectric block 1, and the center axes of the inner-diameter large portion and the small portion are collinear with each other.

In this structure, the small portion formed at the side of the short-circuited end surface is designed approximately in an elliptical sectional shape, and thus the distance between the outer conductor and the small portion of each resonator cavity 2*a*, 2*b* is shortened. Therefore, as compared with the conventional dielectric filter shown in FIG. 1A, the self-capacitance at the short-circuited end can be made larger. Further, the mutual capacitance can also be made larger because the confronting surfaces of the small portions of the neighboring resonator cavities 2*a* and 2*b* are large in area. That is, contrary to the first embodiment, the self-capacitance and the mutual capacitance at the side of the short-circuited end surface can be increased. Therefore, the resonance frequency can be heightened, and the dielectric coupling degree is enhanced, so that the degree of the capacitive coupling can be lowered as a whole.

Figure 4:
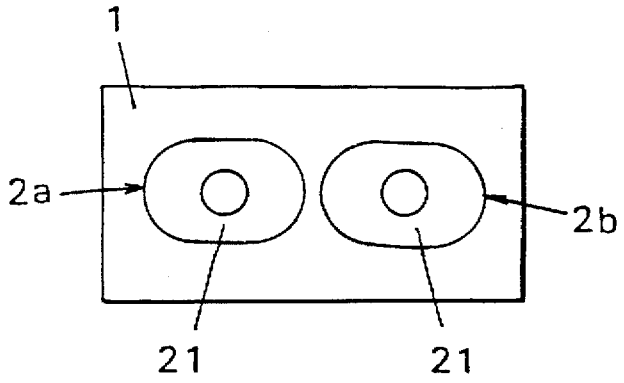
FIG. 4 is a plan view showing a dielectric filter according to a modification of the second embodiment of the present invention.
Figure 5:
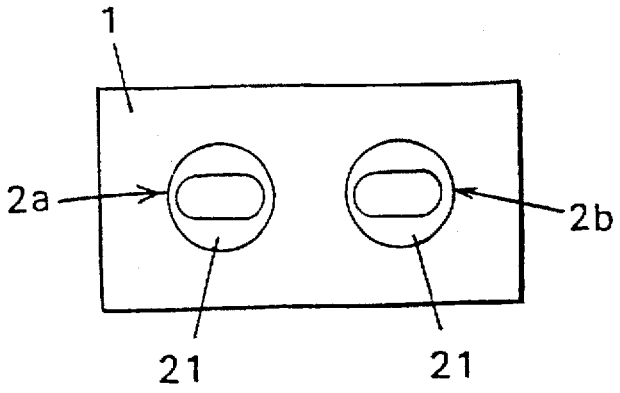
FIG. 5 is a plan view showing a dielectric filter according to another modification of the second embodiment of the present invention.
Figure 6:
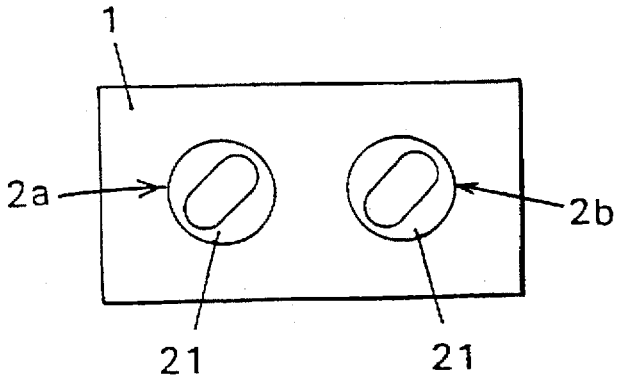
FIG. 6 is a plan view showing a dielectric filter according to another modification of the second embodiment of the present invention.

In the first and second embodiments, the longer diameter of the elliptical portion of each resonator cavity is parallel to the thickness direction of the dielectric block 1. However, the long-diameter direction may also be parallel to the width direction of the dielectric block 1 as shown in FIGS. 4 and 5 or may be oblique with respect to the thickness direction and the width direction of the dielectric block 1 as shown in FIG. 6. Although the small portions are arranged obliquely in the embodiment of FIG. 6, the large portions could be arranged obliquely as well.

In the structure shown in FIG. 4, the long-diameter direction of the large inner-diameter portion formed at the side of the open-circuited end surface is set to be parallel to the width direction of the dielectric block 1, and thus the self-capacitance and the mutual capacitance at the open-circuited end can be increased.

In the structure shown in FIG. 5, the long-diameter direction of the small inner-diameter portion formed at the side of the short-circuited end surface is set to be parallel to the width direction of the dielectric block 1, and thus the self-capacitance and the mutual capacitance at the short-circuited end can be increased.

In the structure shown in FIG. 6, the self-capacitance and the mutual capacitance at the small inner-diameter portion can be varied to various values by changing an oblique (intersectional) angle of the long-diameter direction with respect to the thickness (height) direction of the dielectric block 1.

Figure 7:
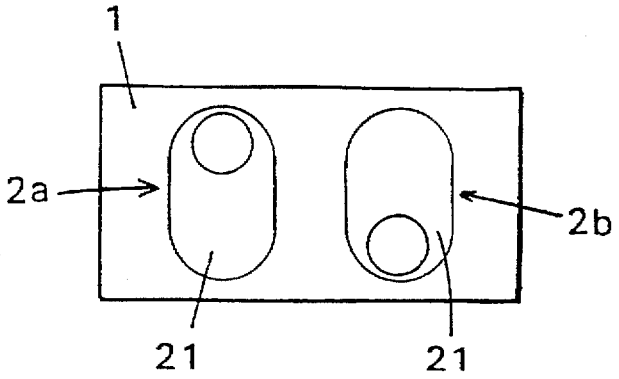
FIG. 7 is a plan view showing a dielectric filter according to a third embodiment of the present invention.

FIG. 7 is a plan view showing a dielectric filter according to a third embodiment of the present invention, which is taken from the side of the open-circuited end surface of the dielectric filter.

In the dielectric filter of this embodiment, the long-diameter direction of the elliptical large portions of the resonator cavities 2*a* and 2*b* is set parallel to the thickness direction of the dielectric block 1, and the circular small portions of the resonator cavities 2*a* and 2*b* are formed so as to be spaced away from each other in the thickness direction of the dielectric block 1 as shown in FIG. 7. That is, the center axis of the small portion of each of the resonator cavities 2*a*, 2*b* is eccentrically displaced from the center axis of the corresponding large portion of the resonator cavity, whereby the small portion of the resonator cavity 2*a* is eccentrically formed at the upper side of the dielectric block 1, while the small portion of the resonator cavity 2*b* is eccentrically formed at the lower side of the dielectric block 1 as shown in FIG. 7.

In this structure, the distance between the outer conductor and the small portion is shorter, so that the self-capacitance at the short-circuited end surface can be made larger, and thus the resonance frequency can be heightened. Further, the distance between the small portions is larger, so that the mutual capacitance at the short-circuited end can be made smaller. Therefore, the degree of inductive coupling is reduced, and the degree of capacitive coupling can be set to a larger value than that of the first embodiment.

Figure 8:
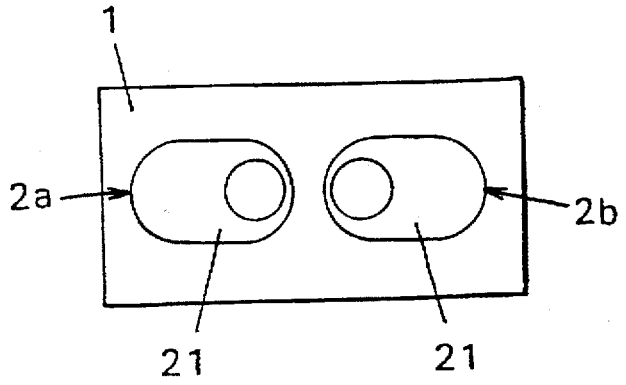
FIG. 8 is a plan view showing a dielectric filter according to a modification of the third embodiment of the present invention.
Figure 9:
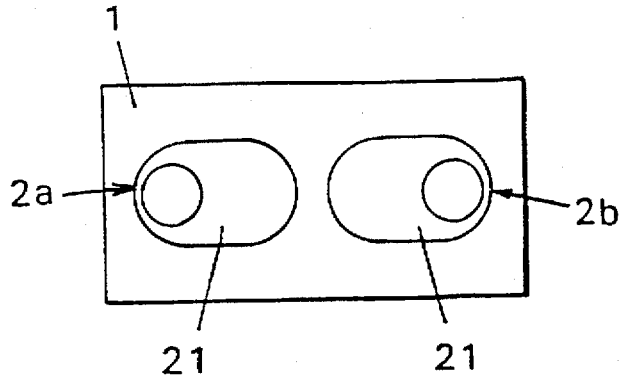
FIG. 9 is a plan view showing a dielectric filter according to another modification of the third embodiment of the present invention.

The eccentric orientation of the small portions is not limited to that shown in FIG. 7. As shown in FIGS. 8 and 9, the long-diameter direction of the large portions may be set parallel to the width direction of the dielectric block with the circular small portions being arranged eccentrically in the width direction as shown in FIGS. 8 and 9.

In the structure shown in FIG. 8, the distance between the respective axes of the small inner-diameter portions formed at the side of the short-circuited end is as short as possible, so the mutual capacitance at the short-circuited end can be set to a large value. Therefore, the degree of inductive coupling energy can be made higher than the capacitive coupling energy as a whole. That is, the coupling between the resonators can be made inductive coupling, and thus an attenuation pole can be formed at a high side of the pass band.

In the structure shown in FIG. 9, the distance between the respective axes of the small inner-diameter portions formed at the side of the short-circuited end is as long as possible, and thus strong capacitive coupling can be obtained.

In the dielectric filter of each embodiment as described above, the large inner-diameter portion of the resonator cavity is at the side of the open-circuited end surface. However, the large inner-diameter portion may also be formed at the side of the short-circuited end surface. In this case, variations of the resonance frequency and the coupling type (capacitive coupling or inductive coupling) are substantially converse to those as described above.

Furthermore, in the embodiments as described above, either the large portion or the small portion is designed to have an approximately elliptical shape in section, and the other portion is designed to have a circular shape in section. However, the sectional shapes of the resonator cavities are not limited to the above shapes, and any shape may be adopted insofar as the shapes of the large portion and the small portion are different.

Still furthermore, in the embodiments as described above, the dielectric filter has two resonator cavities each having a step portion, which are formed in the dielectric block. However, the dielectric filter may have three or more resonator cavities. More generally, this invention is applicable to any dielectric filter in which a plurality of resonator cavities are formed in a single dielectric block, in which at least one resonator cavity has a step portion.

As described above, according to the dielectric filter of the present invention, the large portion and the small portion of the resonator cavity having the step portion are designed to have different sectional shapes, whereby the self-capacitance and the mutual capacitance at the large portion and/or the small portion can be set to various values. Therefore, the degree of freedom in design of filter characteristics, such as the resonance frequency, the coupling degree between resonators, the coupling type, etc. can be improved, and various and excellent filter characteristics can be obtained by using a dielectric filter having a desired body size.

Furthermore, the adjustable range of the self-capacitance and the mutual capacitance can be broadened because the center axis of the small portion can be shifted from the center axis of the large portion in an up-and-down, a right-and-left or an oblique direction, so the degree of freedom of design in filter characteristics can be further improved.

Although the present invention has been described in relation to particular embodiments thereof, many other variations and modifications and other uses will become apparent to those skilled in the art. Therefore, the present invention is not limited by the specific disclosure herein, but only by the appended claims.

What is claimed is:

1. A dielectric filter comprising a dielectric block having a thickness direction, a width direction and a length direction, a plurality of resonator cavities in said dielectric block arranged along said length direction, a respective inner conductor on a corresponding surface of each of said resonator cavities and an outer conductor on an outer surface of said dielectric block, at least one of said resonator cavities being stepped, said at least one resonator cavity comprising a large inner-diameter portion, a small inner-diameter portion and a step portion between said large and small inner-diameter portions, said large inner-diameter portion and said small inner-diameter portion of the at least one stepped resonator cavity having different respective cross-sectional shapes; wherein one of said large and small inner-diameter portions of the at least one stepped resonator cavity has an elongated cross-sectional shape; wherein said inner-diameter portion of the at least one stepped resonator cavity with elongated cross-sectional shape has a longest diameter extending obliquely with respect to said thickness direction and said width direction of said dielectric block.

2. The dielectric filter of claim 1, wherein said small inner-diameter portion of the at least one stepped resonator cavity has said elongated cross-sectional shape.

3. The dielectric filter of claim 1, wherein the other of said large and small inner-diameter portions of the at least one stepped resonator cavity has a substantially circular cross-sectional shape.

4. The dielectric filter of claim 3, wherein said small inner-diameter portion of the at least one stepped resonator cavity has said elongated cross-sectional shape.

* * * * *